United States Patent [19]

Takamatsu

[11] 3,977,052

[45] Aug. 31, 1976

[54] AUTOMATICALLY LOCKING SLIDER FOR CONCEALED SLIDE FASTENERS

[75] Inventor: Ikuo Takamatsu, Uozu, Japan

[73] Assignee: Yoshida Kogyo Kabushiki Kaisha, Japan

[22] Filed: Dec. 8, 1975

[21] Appl. No.: 638,635

[30] Foreign Application Priority Data

Dec. 13, 1974 Japan ..... 49-152124[U]

[52] U.S. Cl. ..... 24/205.14 R; 24/205.1 R

[51] Int. Cl.[2] ..... A44B 19/30

[58] Field of Search ..... 24/205.14 R, 205.14 K, 24/205.1 R

[56] References Cited

UNITED STATES PATENTS 3,013,319 12/1961 Ryser ..... 24/205.14 R 3,798,715 3/1974 Moertel ..... 24/205.1 R

*Primary Examiner*—Bernard A. Gelak

*Attorney, Agent, or Firm*—Bucknam and Archer

[57] ABSTRACT

An automatic slider lock mechanism releasable by a pull tab, comprising a locking leaf spring arranged under the island separator on the front end of the slider body, and an actuating lever received in an aperture formed through the separator. The actuating lever has a pair of shoulders at its bottom end which are urged by the leaf spring into engaging contact with the bottom edges of the separator. Upon exertion of a pull on the pull tab coupled to the top end of the actuating lever, the latter is pivoted within the aperture to cause retraction of a locking pawl at one end of the leaf spring away from the guide channel in the slider body.

2 Claims, 4 Drawing Figures

AUTOMATICALLY LOCKING SLIDER FOR CONCEALED SLIDE FASTENERS

BACKGROUND OF THE INVENTION

1. Field of the Invention

This invention relates generally to slide fasteners, and in particular to the provision of an automatically locking slider for use on a concealed slide fastener, such that the slider is automatically locked against movement in any desired position on interlocking rows of fastener elements or scoops when there is no pull on its pull tab.

2. Prior Art

According to a typical prior art slider lock mechanism comparable to that of this invention, a rod-like lever is inserted into a hole formed in the slider body, and this lever and a connector ring for the pull tab are embracingly engaged and retained in position by a leaf spring having a locking pawl. This prior art slider is constituted of so many parts, of such complex construction, that its assemblage is highly troublesome and time-consuming, requiring the precise setting of its working parts in the predetermined relative positions. Inevitably, therefore, the assembled sliders contain a relatively high percentage of defective ones.

SUMMARY OF THE INVENTION

It is an object of this invention to provide an improved automatically locking slider for a concealed slide fastener which is constituted of a minimum number of parts, which is extremely easy to assemble, but which is positive in operation.

With this and other objects in view, the present invention provides, in a slider for a concealed slide fastener of the type having an island separator mounted centrally on the front end of the slider body, an automatic lock mechanism comprising a locking leaf spring arranged under the body and having a locking pawl at its rear, free end of which normally projects into the guide channel in the slider body for interference contact with interlocking rows of fastener elements passing therethrough, and an actuating lever pivotally received in an aperture formed in the island separator in a direction perpendicular to the general plane of the slider body. The actuating lever has a pair of shoulders at its bottom end which are spaced in the front-to-rear direction of the slider body and which are urged upwardly by the locking leaf spring, normally into engaging contact with a pair of opposed edges of the island separator at the bottom end of the aperture. Thus, when a pull is exerted on a pull tab connected to the actuating lever during the fastener closing or opening movement of the slider, the lever is pivoted within the aperture to cause retraction, by either of its two shoulders, of the locking pawl away from the guide channel against the force of the leaf spring.

The above and other objects, features and advantages of the improved automatically locking slider according to this invention will be apparent from the following detailed description of a typical form thereof, with reference had to the accompanying drawings in which like reference characters refer to like parts throughout the several views.

DESCRIPTION OF THE PREFERRED EMBODIMENT

Figure 1:
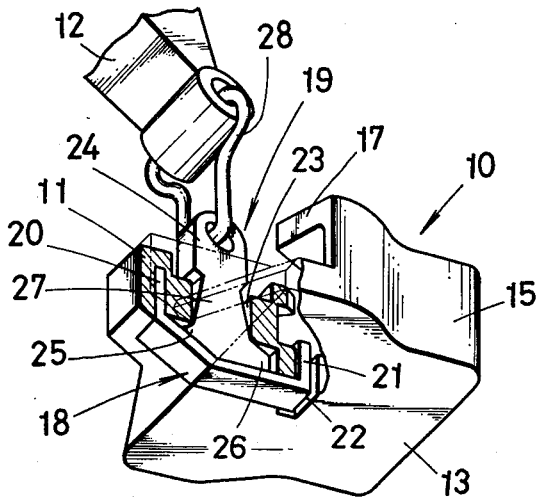
FIG. 1 is a perspective view of the preferred form of the automatically locking slider according to this invention, in which the pull tab is shown fragmentarily because of its conventional nature and the slider body is shown partly broken away to clearly reveal the details of the automatic lock mechanism.
Figure 2:
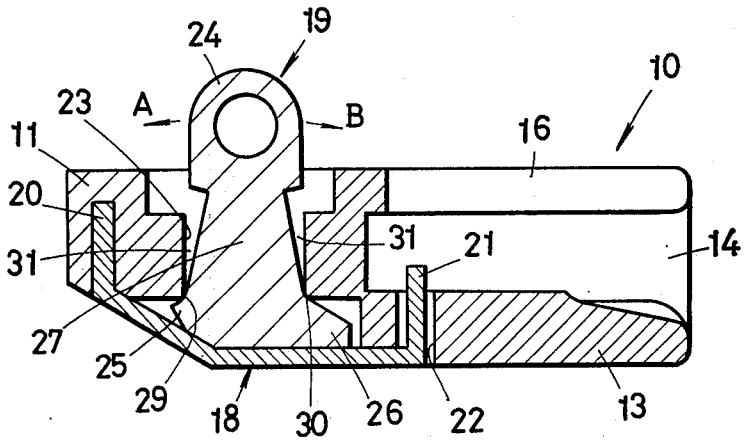
FIG. 2 is a cross-sectional view taken along the central longitudinal axis of the automatically locking slider of FIG. 1.

With reference to the accompanying drawings and in particular to FIGS. 1 and 2 thereof, the illustrated form of the automatically locking slider constructed according to this invention comprises a body 10, island separator 11, and pull tab 12. The slider body 10 has a front branched end portion and rear stem end portion, with the island separator 11 arranged centrally on the front branched end.

The slider body 10 includes a bottom wall or wing 13 having a pair of side walls 14, 15. A pair of lips 16, 17 turn inwardly from the side walls 14, 15 to define therebetween an avenue for the entrance of the pair of stringers, not shown, of the concealed slide fastener. The slider body 10 of the foregoing configuration cooperats with the island separator 11 to define the usual Y-shaped guide channel for the interlocking rows of fastener elements or scoops of the stringers.

The automatic lock mechanism of the slider comprises a locking leaf spring 18 and actuating lever 19. The locking leaf spring 18, arranged under the slider body 10, is securely embedded at its front end 20 in the body or in the island separator 11 and extends rearwardly to terminate in a locking pawl 21 angled upwardly. The locking pawl 21 extends with clearance through an opening 22 in the bottom wall 13 of the slider body 10 and normally projects into the guide channel in the body for interference contact with the rows of fastener elements passing therethrough.

The actuating lever 19 is received in an aperture 23 formed through the island separator 11 in a direction perpendicular to the general plane of the slider body 10. In its preferred form the actuating lever 19 is shown to comprise a head 24 at its top end, a pair of shoulders 25, 26 at its bottom end which are spaced in the front-to-rear direction of the slider body 10, and neck 27 extending between the head and the shoulders. The pull tab 12 of the slider is pivotally coupled to the head 24 of the actuating lever via a connector ring 28.

As will be best seen from FIG. 2, the actuating lever 19 is urged upwardly by the locking leaf spring 18, in such a manner that its shoulders 25 and 26 are normally in engaging contact with a pair of opposed edges 29 and 30 of the island separator 11 at the bottom end of the aperture 23.

The actuating lever 19 must be pivotable within the aperture 23 in both forward and rearward directions of the slider body 10, as indicated by the arrows A and B in FIG. 2, to cause retraction of the locking pawl 21 away from the guide channel in the slider body against the biasing force of the leaf spring 18. To permit such pivotal motion of the actuating lever 19, its neck 27 is tapered upwardly so that clearances 31 may normally exist on the front and rear sides of the neck within the aperture 23.

Figure 3A:
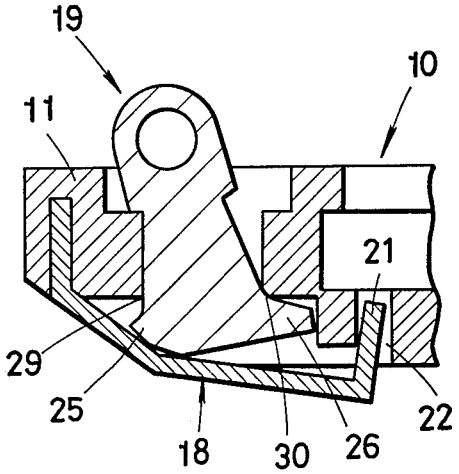
FIGS. 3A and 3B are fragmentary views, similar in section to FIG. 2, that are explanatory of the operation of the automatic lock mechanism during slider movement in the fastener closing and fastener opening directions, respectly.
Figure 3B:
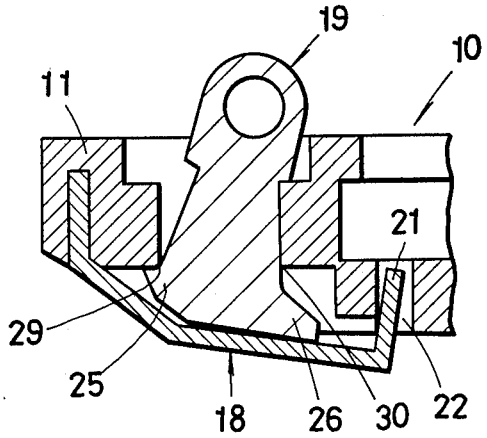

In the use of the concealed slide fastener incorporating the automatically locking slider according to the invention, a pull is exerted via the pull tab 12 and connector ring 28 on the actuating lever 19 as indicated by the arrow A in FIG. 2 during the forward or fastener closing movement of the slider along the rows of fastener elements. As a consequence, the actuating lever 19 pivots forwardly about the rear shoulder 26, as illustrated in FIG. 3A, so that the front shoulder 25 of the lever presses down the leaf spring 18 to cause retraction of the locking pawl 21 into the opening 22 away from the guide channel in the slider body 10. The slider is therefore free to move along the rows of fastener elements in the fastener closing direction.

During the rearward or fastener opening movement of the slider, on the other hand, a pull is exerted on the actuating lever 19 as indicated by the arrow B in FIG. 2, so that the lever pivots rearwardly about the front shoulder 25. The actuating lever 19 thus presses down the leaf spring 18 with its rear shoulder 26 to cause retraction of the locking pawl 21 into the opening 22 away from the guide channel in the slider body 10. The slider is therefore also free to move along the rows of fastener elements in the fastener opening direction.

When the pull on the actuating lever 19 is released at the end of either the fastener closing or opening movement of the slider, the actuating lever and locking pawl both return to the normal positions of FIG. 2 by the biasing force of the leaf spring 18. The slider is then automatically locked against movement in the desired position on the rows of fastener elements.

It is noteworthy that the automatically locking slider according to this invention is extremely easy to assemble. For assemblage, the slider body 10 is first placed upside down, and the actuating lever 23 is inserted fully into the aperture 23, with its head 24 foremost. While the actuating lever has its shoulders 25 and 26 held in engaging contact with the opposed edges 29 and 30 of the island separator 11 under its own weight, the locking leaf spring 18 is placed over the projecting end of the lever, with its locking pawl 21 inserted into the opening 22 in the bottom wall 13 of the slider body. The front end 20 of the leaf spring 18 is then secured to the slider body 10 or to its island separator 11, and thereafter the pull tab 12 is connected to the head 24 of the lever with the connector ring 28.

As may be apparent from the foregoing, the various constituent parts of the slider can be readily installed in their predetermined relative positions, and the assemblage of the slider is so simple as to permit easy automation.

While the automatically locking slider according to the invention has been shown and described hereinbefore in its preferred form, it is, of course, understood that the invention itself is not to be restricted by the exact details disclosed herein but is inclusive of many modifications comprehended within the scope of the following claims.

What is claimed is:

1. In a slider for a concealed slide fastener which includes a body having an island separator at its front end, said island separator cooperating with said body to define a generally Y-shaped guide channel through the latter, an automatic lock mechanism comprising, in combination, a locking leaf spring arranged under the body, said locking leaf spring being affixed at its front end to the body and having at its rear end a locking pawl which normally projects into the guide channel in the body, and an acutating lever received in an aperture formed through the island separator in a direction perpendicular to the plane of the body, said actuating lever having a pair of shoulders at its bottom end which are spaced in the front-to-rear direction of the body and which are urged by said locking leaf spring normally into engaging contact with a pair of opposed edges of the island separator at the bottom end of said aperture, said actuating lever being received in said aperture so as to be pivotable in both forward and rearward directions of the body to cause retraction of said locking pawl away from the guide channel against the force of said locking leaf spring.

2. The automatic lock mechanism according to claim 1, wherein said actuating lever comprises a head at its top end and an upwardly tapering neck between said head and said shoulders, said neck being received in said aperture so as to permit the pivotal motion of said actuating lever with respect to the island separator.

* * * * *